United States Patent [19]

Smith

[11] 3,941,046

[45] Mar. 2, 1976

[54] REFUSE COMPACTOR APPARATUS

[76] Inventor: Jimmy D. Smith, P. O. Box 94176, Oklahoma City, Okla. 73109

[22] Filed: Aug. 29, 1974

[21] Appl. No.: 501,678

[52] U.S. Cl. ..... 100/45; 100/52; 100/73; 100/226; 100/269 R

[51] Int. Cl.[2] ..... B30B 15/30

[58] Field of Search ..... 100/45, 73, 52, 226, 229 A, 100/227, 228, 269 R

[56] References Cited

UNITED STATES PATENTS

| | | | |
|---|---|---|---|
| 1,182,369 | 5/1916 | Haniquet | 100/52 |
| 2,253,617 | 8/1941 | Griffith | 100/52 X |
| 2,812,543 | 11/1957 | Stacy | 100/226 X |
| 3,589,277 | 6/1971 | Gray | 100/226 X |
| 3,669,009 | 6/1972 | Pratt | 100/52 |
| 3,691,967 | 9/1972 | Mettetal | 100/73 X |
| 3,756,143 | 9/1973 | Hennells | 100/229 A |
| 3,868,903 | 3/1975 | Montalbano | 100/45 |

OTHER PUBLICATIONS

Pamphlet Entitled "Tite-Wad" 3 pp. dated Mar. 21, 1973.

*Primary Examiner*—Billy J. Wilhite
*Attorney, Agent, or Firm*—William R. Laney

[57] ABSTRACT

A vertically extending framework having a hydraulic ram subassembly mounted in the framework for pivotation about a horizontal axis, and spaced from the lower end of the framework to accommodate a refuse receptacle within the framework under the ram. A disinfectant injection pump is mounted in the hydraulic ram for automatically discharging a disinfectant into refuse compressed by the ram. The ram is double acting, and valve means is provided for automatically retracting the ram when a predetermined force opposes the outward extension of the piston of the ram.

18 Claims, 5 Drawing Figures

REFUSE COMPACTOR APPARATUS

BACKGROUND OF THE INVENTION

1. Field of the Invention

This invention relates to devices for compressing refuse within a container, and more particularly, to hydraulically operated rams, or piston and cylinder assemblies, which can be actuated to compress refuse into a relatively small space within a container.

2. Brief Description of the Prior Art

Recently, several types of hydraulically operated refuse compacting devices have been provided and marketed, and some of these devices are susceptible to operation by household water pressure. Some of these devices are double acting hydraulic piston and cylinder assemblies and function quite well, provided there is sufficient strength in the container into which the garbage or refuse is compressed to prevent splitting or damage. Among the prior patents which have issued on these types of devices may be cited U.S. Pat. No. 3,800,694 to Miller et al; U.S. Pat. No. 3,752,066 to Charles; U.S. Pat. No. 3,763,773 to Clay; U.S. Pat. No. 3,691,967 to Mettatal; and U.S. Pat. No. 3,654,855 to Longo.

BRIEF DESCRIPTION OF THE PRESENT INVENTION

The present invention is an improved garbage or refuse compacting apparatus which includes a vertically extending framework having a hydraulic ram subassembly mounted in the framework for pivotation about a horizontal axis. Space is provided within the framework below the ram to accommodate a garbage can or other trash receptacle so that the piston of the ram may be extended downwardly into such container to compress the refuse contained therein. A disinfectant injection pump is mounted in the hydraulic ram for automatically discharging a disinfectant into the refuse compressed by the ram is being actuated. The ram is double acting, and valve means is provided for automatically retracting the piston of the ram when a predetermined force opposes the continued extension of the piston against the compressed refuse.

An important feature of a preferred embodiment of the present invention is the method of mounting the disinfectant injection pump in the ram so that, during the retraction stroke of the ram, disinfectant is automatically jetted through the central portion of a disc carried on one end of a piston which extends out of the cylinder of the ram, which disc is used to compress the refuse. The disinfectant injection pump is automatically synchronized in its operation with the operation of the ram so that disinfectant is drawn into the pump from a reservoir located over the internal piston of the ram at a time when the ram is extended, and then is discharged through a jet or orifice located at the end of the injection pump cylinder at a time when the ram undergoes its retraction stroke.

An important object of the present invention is the provision of a refuse compacting apparatus which can be operated from a source of water available in city households operating on normal city pressure.

Another object of the invention is to provide a refuse compactor which is double acting and automatically undergoes a retraction stroke after the completion of a compression stroke by means of which refuse is compacted to a degree such that a predetermined back pressure is offered to further extension of the ram forming a part of the apparatus.

An additional object of the present invention is to provide a sturdily built refuse compactor which can be operated from a normal household water supply, and which is characterized in having a long and trouble-free operating life.

Another important object of the invention is to provide a refuse compactor which can be used for compressing and compacting ordinary household refuse, and which automatically injects a disinfectant or pesticide into the compacted refuse.

Additional objects and advantages of the invention will become apparent as the following detailed description of the invention is read in conjunction with the accompanying drawings which illustrate the invention.

GENERAL DESCRIPTION OF THE DRAWINGS

DETAILED DESCRIPTION OF A PREFERRED EMBODIMENT OF THE INVENTION

Figure 1:
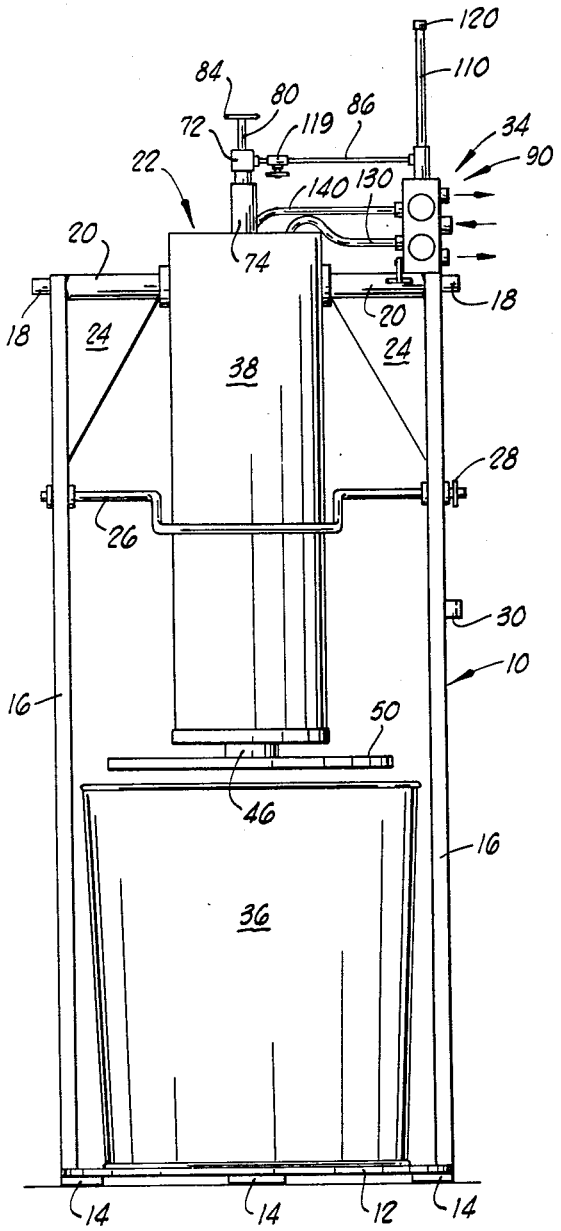
FIG. 1 is a front elevation view of the refuse compacting apparatus of the invention.

Referring initially to FIG. 1 of the drawings, shown therein as a part of the refuse compacting apparatus of the invention, is an upstanding or vertically extending framework 10. The framework 10 includes a disc shaped base plate 12 having spacer blocks 14 secured to its lower side. The framework further includes a pair of vertically extending stanchions 16 which project upwardly from opposite sides of the base plate 12. The upper ends of the stanchions 16 receive stub shafts 18 projecting from the opposite ends of a pair of pivot rods 20. The pivot rods 20 project into journals carried on the opposite sides of the cylinder of a hydraulic ram subassembly designated generally by reference numeral 22, and hereinafter described in detail. A pair of triangular brace plates 24 are connected between the sleeves 20 and the vertical stanchions 16.

Pivotally mounted intermediate the ends of the vertical stanchions 16 is a generally U-shaped crank rod 26. The opposite ends of the crank rod 26 are projected through suitable journals in the stanchions 16. One end of the crank rod is connected to a pivot arm 28 which projects horizontally when the hydraulic ram subassembly 22 is in the position shown in full lines in FIGS. 1 and 2. The stanchion 16 which receives that end of the crank rod 26 carrying the pivot arm 28 also carries an arresting bracket 30 which can be used for engagement of the pivot arm 28 when the pivot arm is pivoted to the position shown in dashed lines in FIG. 2 for a purpose hereinafter described.

Mounted on the upper end of one of the stanchions 16 is a valve subassembly designated generally by reference numeral 34. The valve subassembly 34 is adapted for connection to a source of hydraulic pressure fluid, such as water (not shown).

Positioned on the base plate 12 in the lower portion of the framework 10 is a generally cylindrically shaped refuse receptacle 36. The refuse receptacle 36 is positioned directly below the hydraulic ram subassembly 22, and the ease with which the receptacle 36 may be placed in position beneath the ram or removed therefrom for emptying or the like is facilitated by pivoting the hydraulic ram assembly to the out of the way, nonobstructing position depicted in dashed lines in FIG. 2, using the pivot arm 28 and crank rod 26 for this purpose.

Figure 3:
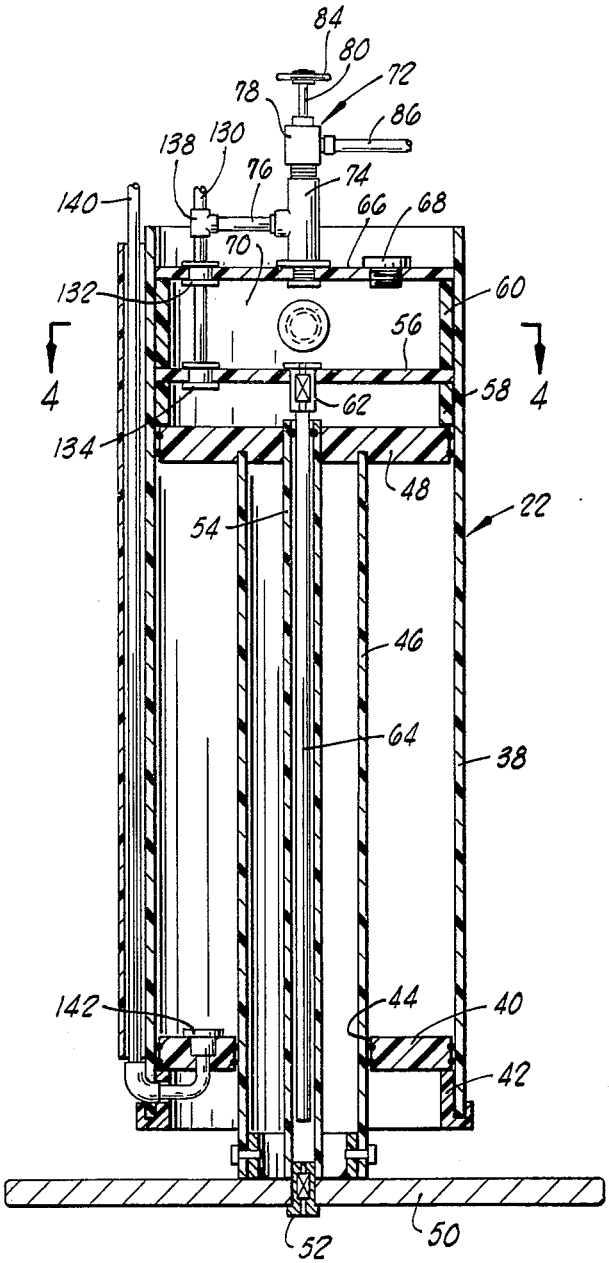
FIG. 3 is a vertical sectional view through the center of the hydraulic ram forming a portion of the refuse compacting apparatus of the invention.
Figure 4:
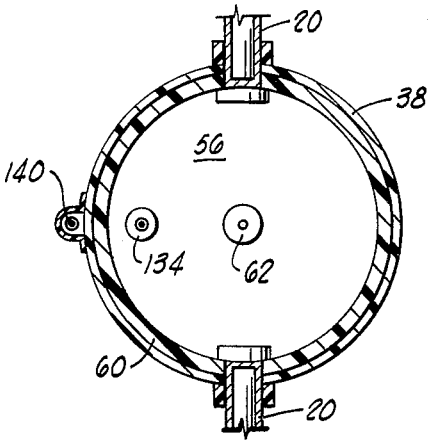
FIG. 4 is a sectional view taken along line 4—4 of FIG. 3.

The construction of the hydraulic ram assembly 22 and a disinfectant injection pump located therein is best illustrated in FIGS. 3 and 4 of the drawings. As shown in FIG. 3, the ram subassembly includes an outer cylindrical housing 38 which includes a fixed, centrally apertured end plate 40 disposed near the lower end of the cylindrical housing 38, and retained in position by means of an annular retainer ring 42 secured to the lower end of the housing 38. The end plate 40 carries a plurality of sealing rings 44 which sealingly engage the outer surface of a hollow cylindrical position rod 46. The upper end of the cylindrical piston rod 46 is secured to an annular internal piston plate 48 which is slidably mounted for reciprocation in the cylindrical housing 38.

At its lower end, the cylindrical piston rod 46 is secured to a compacting external piston plate 50. The piston plate 50 is centrally apertured to accommodate a spring check valve 52 which communicates with the interior of an elongated injection pump sleeve 54. The lower end of the injection pump sleeve 54 is secured around the spring check valve 52 and to the upper side of the compacting plate 50. The upper end of the injection punp sleeve 54 is pressed into a central opening in the piston plate 48 and secured to the piston plate for movement therewith.

Spaced vertically above the piston plate 48 in the cylindrical housing 38 is a stationary partition plate 56. The partition plate 56 is retained in the illustrated location within the cylindrical housing 38 by a pair of annular spacer rings 58 and 60 secured to the inner wall of the cylindrical housing 38. The spacer ring 58 functions, in addition to locating the partition plate 56, as a stop limiting the upward movement of the piston plate 48 within the cylindrical housing 38. A ball check valve 62 is pressed into a receiving opening in the center of the partition plate 56 and is secured to the upper end of an elongated tube 64 forming a portion of the injection pump which includes the injection pump sleeve.

Secured within the outer cylindrical housing 38 above the annular spacing ring 60 by any suitable means, such as by screws or bolts (not shown), in a way which permits detachment and removal, is a cover plate 66. The cover plate 66 is provided with a threaded opening to receive a threaded filler cap 68 so that a disinfectant liquid reservoir 70 defined between the stationary partition plate 56 and the cover plate 66 can be filled with a disinfectant liquid which is dispensed by the disinfectant injection pump in a manner hereinafter described. The cover plate 66 also has mounted in the center thereof, a pressure relief regulator valve subassembly designated generally by reference numeral 72. The regulator valve subassembly 72 includes a T-shaped tubular body 74 which is closed at its lower end and has a projecting portion connected to a short tubular conduit 76. The upper end of the T-shaped tubular body 74 is connected to a valve body 78 which contains a pressure relief check valve seat (not shown). A spring loaded check valve member (not shown) is operatively connected to the lower end of a threaded stem 80 and can be adjusted in the pressure at which it is seated upon the valve seat by means of an operator handle 84 so as to selectively adjust the pressure relief setting of the valve and cause it to open only when a predetermined pressure is exerted by hydraulic power fluid in the short tubular conduit 76.

The main valve subassembly 34 includes a four way valve 90 having a cylindrical body 92 which contains a movable, double acting piston 94. The body of the piston 94 carries a pair of spaced, annular sealing elements 95 around the outer periphery thereof. A pair of hydraulic fluid discharge return ports 96 and 98 project from the cylindrical valve body 92, and a charging or inlet port 100 is also provided on the valve body, and affords communication with the interior thereof. A pair of hydraulic fluid delivery ports 102 and 104 also project from the valve body 92 and the arrangement of the ports 96–104 is such that hydraulic fluid charged to the four way valve 90 from the charging port 100 can be alternately delivered to the hydraulic ram subassembly via either of the delivery ports 102 or 104, with the alternate port not in use for delivery being used to return hydraulic fluid to the four way valve followed by discharge through one or the other of the ports 96 or 98. The piston 94 is reciprocably mounted in the valve body 92 to afford alternating communication between the delivery ports 102 and 104 and the discharge ports 96 and 98 as hereinafter described.

Positioned at the upper end of the piston 94 adjacent the top of the valve body 92 is a sealing disc 106 which carries around the outer periphery thereof, an annular sealing ring 108 which is in sliding, sealing contact with the internal wall of the valve body 92. Secured to the upper end of the valve body 92 is an air accumulator housing 110. The air accumulator housing 110 is an elongated tubular member having a securement flange 112 around the lower end thereof, which securement flange allows the accumulator to be secured to the upper end of the valve body 92 of the valve subassembly 34 by means of suitable bolts or screws 114.

The hollow interior of the air accumulator housing 110 communicates with a port or opening 116 formed through the upper end of the valve body 92 of the four way valve 90. A radially outwardly projecting threaded port 118 facilitates connection of the air accumulator housing 110 with the tubular conduit 86. A hydraulic fluid draining petcock 119 is provided in the conduit 86 adjacent the air accumulator housing 110. A threaded cap 120 is secured over the open upper end of the air accumulator 10. An operator handle 122 is provided outside the lower end of the valve body 92, and is connected through a shaft 124 carrying an eccentric cam thereon to an operating stem 126 projecting from the lower end of the piston 94.

For the purpose of introducing hydraulic fluid to the double acting hydraulic ram subassembly, a tubular conduit 130 is connected to the threaded port 102 on the valve body 92 and extends through a suitable seal 132 in the cover plate 66 and is threaded into a fitting 134 provided in the stationary partition plate 56, and affording communication therethrough. Hydraulic fluid can thus be delivered to and from the four way valve 90 via the tubular conduit 130 to and from the space provided between the stationary partition plate 56 and the movable annular piston plate 48. It will be noted that the short tubular conduit 76 has one of its ends connected through a T-fitting 138 to the conduit 130. A tubular conduit 140 is connected between the threaded delivery port 104 of the four way valve subassembly 34 and extends through the cylindrical housing to a fitting 142 provided in the centrally apertured end plate 40, and providing communication therethrough.

OPERATION

Figure 2:
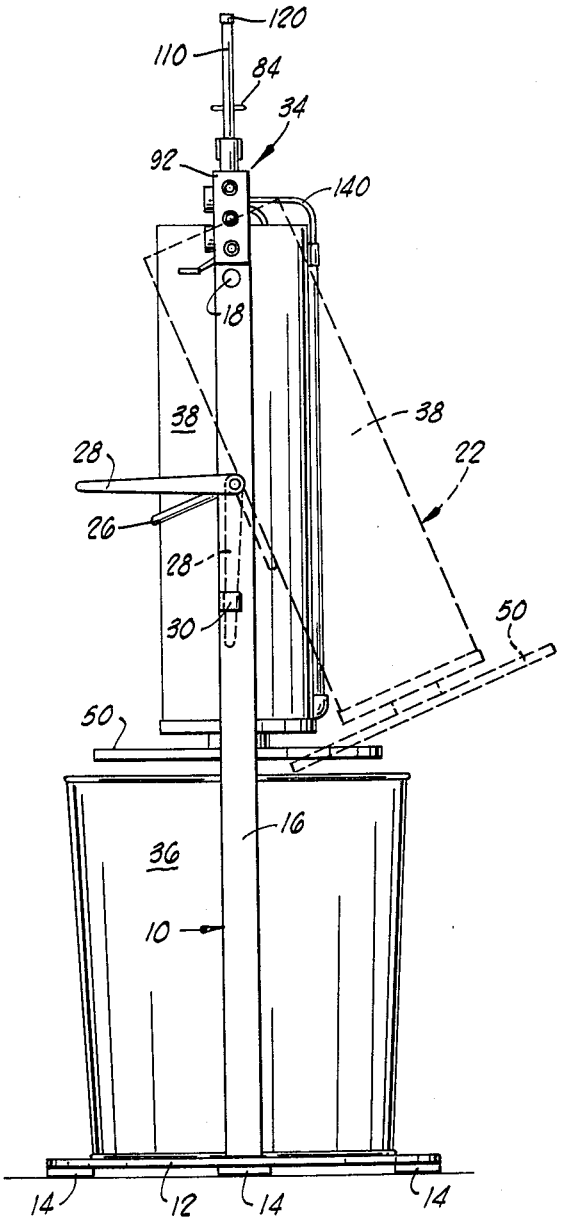
FIG. 2 is a side elevation view of the refuse compacting apparatus of the invention.

In the operation of the refuse compactor apparatus of the invention, the hydraulic ram subassembly 22 can be swung outwardly to the dashed line position shown in FIG. 2 to permit a refuse receptacle 36 to be placed therebeneath preparatory to the compaction of refuse in the receptacle. In the usage of the apparatus, an empty receptacle 36 may be placed in position on the base plate 12 of the framework 10, and the hydraulic ram subassembly 22 permitted to remain in its displaced, out of the way position as trash and refuse is deposited in the receptacle over a period of time. Alternately, a refuse receptacle which is substantially full of refuse ready to be compacted may be placed in position on the base plate 12 of the framework 10, and the ram subassembly then permitted to swing back into position over the refuse receptacle preparatory to compaction.

Figure 5:
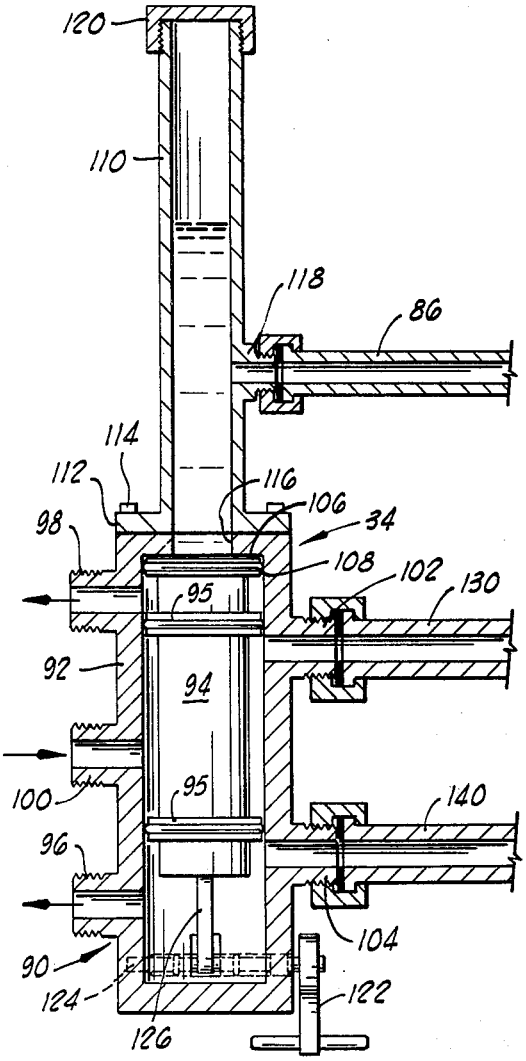
FIG. 5 is a sectional view through an air accumulator dome forming a portion of the valving subassembly of the invention.

At the time that the receptacle 36 is substantially full of refuse, and the hydraulic ram subassembly 22 is swung into position over the receptacle, the hydraulic system is actuated for the purpose of activating the ram subassembly. For this purpose, the operator handle 122 is pivoted downwardly to the position shown in FIG. 5, which action causes the double acting piston 94 to be reciprocated upwardly to the position shown in the same figure. In this status of the four way valve 90, hydraulic power fluid charged to the inlet port 100 passes through the valve and out of the fluid delivery port 102. From this port, the hydraulic power fluid flows through the tubular conduit 130 to the space between the stationary partition plate 56 and the annular piston plate 48.

At this location, the hydraulic power fluid exerts downward pressure on the piston plate 48 causing this piston and the hollow cylindrical piston rod 46 to undergo reciprocation downwardly inside the outer cylindrical housing 38. This movement also is accompanied by the downward movement of the injection pump sleeve 54 around the elongated tube 64 which remains stationary by reason of its securement at its upper end to the ball check valve 62 which is secured in the stationary partition plate 56. As the injection pump sleeve 54 moves downwardly on the elongated tube 64, a disinfectant of pesticidal liquid which is stored in the space between the stationary partition plate 56 and the cover plate 66 is drawn through the ball check valve 62 and fills the space within the injection pump sleeve 54 not occupied by the elongated tube 64.

Downward movement of the hollow cylindrical piston rod 46 also, of course, causes the downward movement of the compacting piston plate 50. This plate bears against the body of refuse within the receptacle 36, and compresses and compacts the refuse as it moves downwardly.

The delivery of hydraulic power fluid to the conduit 130 also results in delivery of hydraulic power fluid via the short tubular conduit 76, the T-shaped tubular body 74 and the tubular conduit 86 to the air accumulator 110. It will be seen in referring to the air accumulator 110 that hydraulic power fluid delivered thereto from the conduit 86 causes compression of the body of air in the upper portion of the air accumulator 110. It should be further pointed out that in passing through the valve body 78, the pressure drop through this throttle valve subassembly can be controlled by the setting of the operator handle 84. Thus, the amount of pressure exerted at any time on the body of air in the upper end of the tubular portion of the air accumulator 110 by the hydraulic fluid delivered thereto via the conduit 86 can be controlled by the preselected setting of the throttle valve subassembly 72, utilizing the operator handle 84. The importance of this control feature of the invention will be shortly explained in greater detail.

As the annular piston plate 48 moves downwardly within the outer cylindrical housing 38, hydraulic power fluid is expressed from the space between the piston plate 48 and the end plate 40 into the tubular conduit 140. The hydraulic power fluid is thus caused to pass from the interior of the outer cylindrical housing 38 of the hydraulic ram subassembly to the four way valve 90. Upon entering the four way valve 90, hydraulic power fluid from the conduit 140 passes through the port 104, through the lower end of the cylindrical valve body 92 and out of the discharge return port 96. From this point, the discharging hydraulic power fluid can be returned to a fluid reservoir or other suitable disposal made (such as discharge to a drain in the case of connection of the apparatus to a household water supply).

As the back pressure on the compacting piston plate 50 builds up due to compression of the refuse below this plate as it moves downwardly, the pressure on the hydraulic power fluid in the space between the stationary partition plate 56 and the annular piston plate 48 is also increased, as in the pressure of hydraulic power fluid in the conduit 130 and the conduit 76. When this pressure exceeds the pre-adjusted force seating the pressure relief check valve in the valve body 78, this valve opens, permitting hydraulic power fluid to flow into the lower portion of the air accumulator 110. The body of pressurized air at this location then continuously exerts a downwardly acting force through the column of hydraulic power fluid to the sealing disc 106 carried at the upper end of the double acting piston 94.

The pressure in the air accumulator 110 then substantially instantaneously builds to a point where the force exerted on the sealing disc 106 is sufficient to cause the double acting piston 94 to reciprocate downwardly in the cylindrical body 92. This shifting of the piston 94 causes the communication between the porting of the cylindrical body 92 to be changed, and hydraulic power fluid entering the body through the charging or inlet port 100 commences to be delivered to the tubular conduit 140 via the fluid delivery port 104. At the same time, and in this status, the hydraulic power fluid between the annular piston plate 48 and the stationary partition plate 56 begins to flow through the conduit 130 to the port 102, and from the port 102 through the cylindrical body 92 to the discharge return port 98. This reversal of fluid flow in the conduits 130 and 140 entails, of course, a reversal in the direction of movement of the annular piston plate 48, and the retraction stroke of the hydraulic ram subassembly is thus commenced. Concurrently, the operator handle 122 is automatically shifted, as a result of the downward movement of the double acting piston 94, to the upwardly extending position. At the time that the annular piston plate 48 reaches its upper limit of travel in which it is contact with the lower end of the annular spacer ring 58, flow of fluid through the conduit 140 is terminated, and the system is then in an at-rest, inoperative status, and awaits the next actuation of the four way valve 90 by downward movement of the operator handle 122 when the time arrives to compact a new body of refuse which has been accumulated in a new refuse receptacle 36 placed beneath the hydraulic ram subassembly.

Although a preferred embodiment of the present invention has been hereinbefore described in order to illustrate and typify the operating and basic principles underlying the invention, it will be perceived that various changes of structure can be effected without departure from the basic principles which underlie the invention. Innovations and changes of this type are therefore deemed to be circumscribed by the spirit and scope of the invention except as the same may be necessarily limited by the appended claims or reasonable equivalents thereof.

What is claimed is:

1. A refuse compacting apparatus comprising:

a fluid powered ram including a cylindrical housing and piston means extensible from the housing;

means for supporting the ram in a vertically elevated position to facilitate compaction of refuse positioned therebelow;

an injection pump including:

an injection pump sleeve connected to said piston means and movable therewith relative to said cylindrical housing; and an elongated tube projecting concentrically into said sleeve and connected to said cylindrical housing for retention in a fixed position as said sleeve moves relative to said housing; and a body of sanitizing additive liquid retained in said housing and communicating with the interior of said elongated tube.

2. A refuse compacting apparatus as defined in claim 1 and further characterized as including means connected to said ram for automatically retracting said piston means into said housing after said piston means is extended against a force increasingly opposing extension up to a predetermined force magnitude.

3. A refuse compacting apparatus as defined in claim 1, wherein said supporting means comprises:

a vertically extending framework pivotally supporting said ram for pivotation about a horizontal axis; and crank means pivotally mounted in said framework and bearing against said ram to facilitate manual pivotation of said ram to a displaced position enabling refuse to be placed in position for compacting.

4. A refuse compacting apparatus comprising:

supporting means;

a fluid powered ram supported on said supporting means in a vertically elevated position to facilitate compaction of refuse positioned therebelow, said fluid powered ram including:

a cylindrical housing pivotally mounted on said supporting means for pivotation about a horizontal axis;

a stationary partition plate in said cylindrical housing and partitioning said housing by extension thereacross;

a centrally apertured end plate positioned in said housing and extending parallel to, and spaced from, said stationary partition plate;

an internal piston plate reciprocably mounted in said cylindrical housing and positioned between said partition plate and end plate;

a piston rod connected to, and movable with, said piston plate and projecting through the central aperture in the end plate and from said cylindrical housing; and a compacting piston plate secured to the end of said piston rod outside said housing; and means connected to the ram for automatically injecting a sanitizing additive liquid into the refuse below the ram as the ram is actuated in compressing the refuse.

5. A refuse compacting apparatus as defined in claim 4 wherein said piston rod is hollow and said additive injection means is mounted in said hollow piston rod for dispensing additive liquid through said compacting piston plate.

6. A refuse compacting apparatus as defined in claim 4 and further characterized as including:

means for introducing a powering fluid to a first space between said stationary partition plate and said internal piston plate;

means for introducing a powering fluid to a second space between said end plate and said internal piston plate; and means for automatically reversing the flow of powering fluid to and from said first and second spaces to reverse the direction of movement of said piston means relative to said housing.

7. A refuse compacting apparatus as defined in claim 6 wherein said automatic reversing means comprises:

valve means including:

a fluid inlet port;

a pair of fluid discharge return ports;

a pair of fluid delivery ports, one of said delivery ports being connected to said means for introducing powering fluid to said first space, and the other delivery port being connected to said means for introducing powering fluid to said second space; and shiftable piston means movable to alternately communicate each of the delivery ports with either the fluid inlet port or one of the fluid discharge ports; and air accumulator means connected to said valve means for automatically shifting said shiftable piston means when air in said accumulator means is compressed to a preselected extent by powering fluid delivered from one of said fluid delivery ports.

8. A refuse compacting apparatus as defined in claim 2 wherein said injection means comprises:

an injection pump sleeve secured to said internal piston plate and movable therewith, said sleeve projecting into said piston rod and connected to said compacting piston plate to deliver liquid through said compacting piston plate; and an elongated tube projecting concentrically into said sleeve and projecting through said stationary partition plate.

9. A refuse compacting apparatus as defined in claim 4 wherein said piston rod is a hollow cylinder;

and wherein said injecting means comprises an elongated tube projecting through said stationary partition plate and concentrically into the interior of said hollow cylindrical piston rod.

10. A refuse compacting apparatus as defined in claim 9 wherein said supporting means comprises:

a vertically extending framework pivotally supporting said ram for pivotation about a horizontal axis; and crank means pivotally mounted in said framework and bearing against said ram to facilitate manual pivotation of said ram to a displaced position enabling refuse to be placed in position for compacting.

11. A refuse compacting apparatus as defined in claim 10 and further characterized as including:

a first check valve positioned in one end of said elongated tube where said elongated tube projects through said stationary partition plate; and a second check valve positioned in said compacting piston plate and communicating with the interior of said hollow cylindrical piston rod.

12. A refuse compacting apparatus as defined in claim 10 and further characterized as including a cover plate positioned in, and extending across, said cylindrical housing on the opposite side of said stationary partition plate from said internal piston plate, said cover plate defining with said stationary partition plate, a reservoir for containing said sanitizing additive liquid.

13. A refuse compacting apparatus comprising:

a double acting hydraulic ram including an internal piston;

frame means for supporting the ram in a vertically elevated position to facilitate compaction of refuse positioned therebelow;

valve means for alternately charging a hydraulic fluid to opposite sides of said internal piston to actuate said ram and reverse the stroke of said internal piston, said valve means including shiftable piston means;

an air accumulator connected to said valve means and defining a space adjacent the piston means of said valve means in one position of said valve means; and conduit means for receiving hydraulic fluid from said valve means when said valve means is in said one position and for delivering hydraulic fluid to said space to compress air in said space.

14. A refuse compacting apparatus as defined in claim 13 wherein said supporting means comprises:

a vertically extending framework pivotally supporting said ram for pivotation about a horizontal axis; and crank means pivotally mounted in said framework and bearing against said ram to facilitate manual pivotation of said ram to a displaced position enabling refuse to be placed in position for compacting.

15. A refuse compacting apparatus comprising:

a double acting hydraulic ram including:

an internal piston;

a hollow piston rod having one of its ends connected to said internal piston; and a compacting plate secured to the other end of said hollow piston rod;

frame means for supporting the ram in a vertically elevated position to facilitate compaction of refuse positioned therebelow;

means for automatically reversing the stroke of the double acting hydraulic ram after compression of the refuse; and means in said hollow piston rod for injecting a disinfectant material through said compacting plate.

16. A refuse compacting apparatus comprising:

a fluid powered ram including:

a cylindrical housing;

an internal piston movably mounted in said cylindrical housing;

a hollow piston rod having an end connected to said internal piston and projecting out of said housing; and a compacting plate connected to the other end of said hollow piston rod and positioned outside said housing;

means for supporting said fluid powered ram in a vertically elevated position to facilitate compaction of refuse positioned therebelow; and means in said hollow piston rod for injecting a disinfectant material through said compacting plate.

17. A refuse compacting apparatus comprising:

a fluid powered ram including:

a cylindrical housing;

a stationary partition plate in said cylindrical housing and partitioning said housing by extension thereacross;

a centrally apertured end plate positioned in said housing on one side of said stationary partition plate and extending substantially parallel to, and spaced from said stationary partition plate;

a cover plate positioned in, and extending across, said cylindrical housing on the opposite side of said stationary partition plate from said centrally apertured end plate, said cover plate defining with such stationary partition plate, a reservoir for containing a sanitizing additive liquid;

an internal piston plate reciprocably mounted in said cylindrical housing and positioned between said partition plate and said end plate;

a piston rod connected to, and movable with, said piston plate and projecting through the central aperture in said end plate and from said cylindrical housing; and a compacting piston plate secured to the end of said piston rod outside said housing;

means for supporting the ram in a vertically elevated position to facilitate compaction of refuse positioned therebelow; and means connected to the ram for automatically injecting a santizing additive liquid into the refuse below the ram as the ram is actuated in compressing the refuse.

18. A refuse compacting apparatus comprising:

a double acting ram including an internal piston;

means for supporting the ram in a vertically elevated position to facilitate compaction of refuse positioned therebelow;

valve means for alternatively charging a hydraulic fluid to opposite sides of said internal piston to actuate said ram and reverse the stroke thereof as said valve means is shifted, said valve means including reciprocable, shiftable piston means;

an air accumulator connected to said valve means and defining a space at one end of said accumulator connected to said valve means at one end of the shiftable piston means of said valve means for placing said space of the air accumulator in communication with said valve means;

conduit means for receiving hydraulic fluid from said valve means when said valve means is in one position, and for delivering hydraulic fluid to said space to compress air in said space;

means mounted in said double acting hydraulic ram for dispensing a sanitizing additive liquid into the refuse immediately below the ram upon stroke reversal of the ram.

* * * * *